US007168225B2

(12) United States Patent
Mattes et al.

(10) Patent No.: US 7,168,225 B2
(45) Date of Patent: Jan. 30, 2007

(54) SADDLE BACKING

(75) Inventors: Peter Mattes, Mahlstetten (DE); Peter Menet, Stein/AR (CH)

(73) Assignee: E.A. Mattes GmbH, Tuttlingen (DE)

( * ) Notice: Subject to any disclaimer, the term of this patent is extended or adjusted under 35 U.S.C. 154(b) by 0 days.

(21) Appl. No.: 10/486,523

(22) PCT Filed: Aug. 8, 2002

(86) PCT No.: PCT/EP02/08871

§ 371 (c)(1),
(2), (4) Date: Sep. 1, 2004

(87) PCT Pub. No.: WO03/014008

PCT Pub. Date: Feb. 20, 2003

(65) Prior Publication Data

US 2005/0048257 A1 Mar. 3, 2005

(30) Foreign Application Priority Data

Aug. 10, 2001 (DE) ..... 101 38 317

(51) Int. Cl.
*B68C 1/12* (2006.01)

(52) U.S. Cl. ..... 54/66

(58) Field of Classification Search ..... 54/44.1, 54/44.5, 65, 66
See application file for complete search history.

(56) References Cited

U.S. PATENT DOCUMENTS

| | | | | | |
|---|---|---|---|---|---|
| 115,772 | A | * | 6/1871 | Schmidt | 54/44.4 |
| 184,975 | A | * | 12/1876 | McCormick | 54/66 |
| 588,481 | A | * | 7/1897 | Erselius | 54/44.1 |
| 721,653 | A | * | 3/1903 | Amos | 54/66 |
| 5,353,577 | A | * | 10/1994 | Thurston | 54/66 |
| 5,575,139 | A | | 11/1996 | Green | 54/66 |
| 6,125,616 | A | * | 10/2000 | Brown | 54/66 |

FOREIGN PATENT DOCUMENTS

| | | |
|---|---|---|
| WO | WO 90/00518 | 1/1990 |
| WO | WO 00/50336 | 8/2000 |

* cited by examiner

*Primary Examiner*—Robert P. Swiatek
(74) *Attorney, Agent, or Firm*—O'Shea, Getz & Kosakowski, P.C.

(57) ABSTRACT

A saddle pad for laying on the back of a riding animal comprises a first side panel, a second side panel and a web from which the first and second side panels hang. The web includes a lengthwise groove configured and arranged to overly the spine of the riding animal, so that the panels resting on the flanks of the riding animal have a greater thickness than the web connecting the first and second panels to one another over the spine, where undersides of the first and second panels that contact the riding animal are made of lambskin.

7 Claims, 5 Drawing Sheets

SADDLE BACKING

BACKGROUND OF THE INVENTION

The invention relates to a saddle pad for laying on the back of a riding animal.

Because riding animals, in particular horses, are especially sensitive in the back region where the saddle rests, saddles, saddlecloths, and the like should be optimally adapted to the anatomy of the riding animal. Such saddle pads must not press on the spine of the riding animal.

It has heretofore been known to fasten the saddle pad in the so-called gullet channel on the underside of the saddle using a special hook-and-loop tape. For this purpose a special glue must be employed to fasten the hook-and-loop tape in the gullet channel of the saddle.

The use of such hook-and-loop tapes with the requisite gluing operation is complicated and for this reason not well accepted among riders.

Therefore, there is a need for a saddle pad for a riding animal in a manner as well suited to the anatomy as possible, it being possible to dispense with hook-and-loop tapes or adhesives.

SUMMARY OF THE INVENTION

A recess in the shape of a lengthwise groove is made in the saddle pad in the region lying over the spine of the riding animal, so that the panels lying on the flanks of the riding animal have a greater thickness than the web lying over the spine and connecting the two panels to one another.

As a result of the measure according to the invention of providing a groove-like recess along the central longitudinal axis of the saddle pad, that is, along the spine of the riding animal, the saddle pad rests only on the flanks of the riding animal, so that a cavity is formed over the spine. For this reason, no pressure is exerted on the spine from above. Instead, the weight of the rider is distributed in large-area fashion via the panels of the saddle pad onto the flanks of the riding animal.

An exemplary embodiment of the saddle pad according to the invention provides a thickened bulge, preferably made of a lambskin covering, at the front and/or rear end, which bulge serves primarily to guard against slipping.

A further exemplary embodiment provides a device for fastening of a cloth, for example a slit through which a strap is passed, at the front and/or rear of the saddle pad on the right and left panels.

The saddle pad according to the invention is preferably fabricated from lambskin, to the skin side of which is sewn a textile fabric, preferably quilted in order to make the padding higher. The saddle pad rests with the fleece side on the riding animal. A stiff quilted material can also be employed as textile fabric.

These and other objects, features and advantages of the present invention will become apparent in light of the following detailed description of preferred embodiments thereof, as illustrated in the accompanying drawings.

DETAILED DESCRIPTION OF THE INVENTION

Figure 1A:
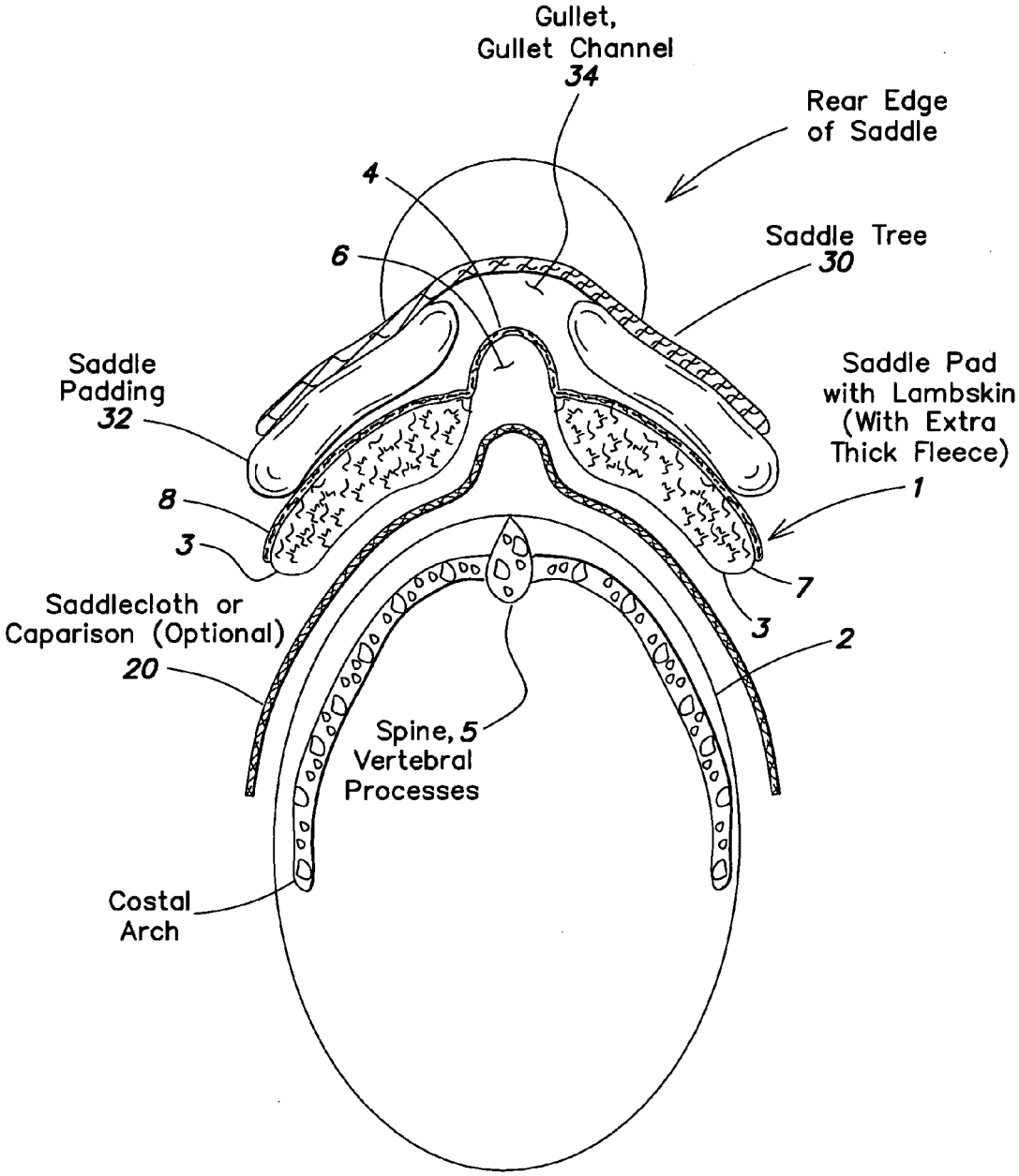
FIGS. 1A–1C illustrate sectional views of a horse in the region of the rear edge of the saddle as well as the front edge of the saddle, as well as a lateral view of a horse with the saddle pad set in place and with saddle set thereon, respectively.
Figure 1B:
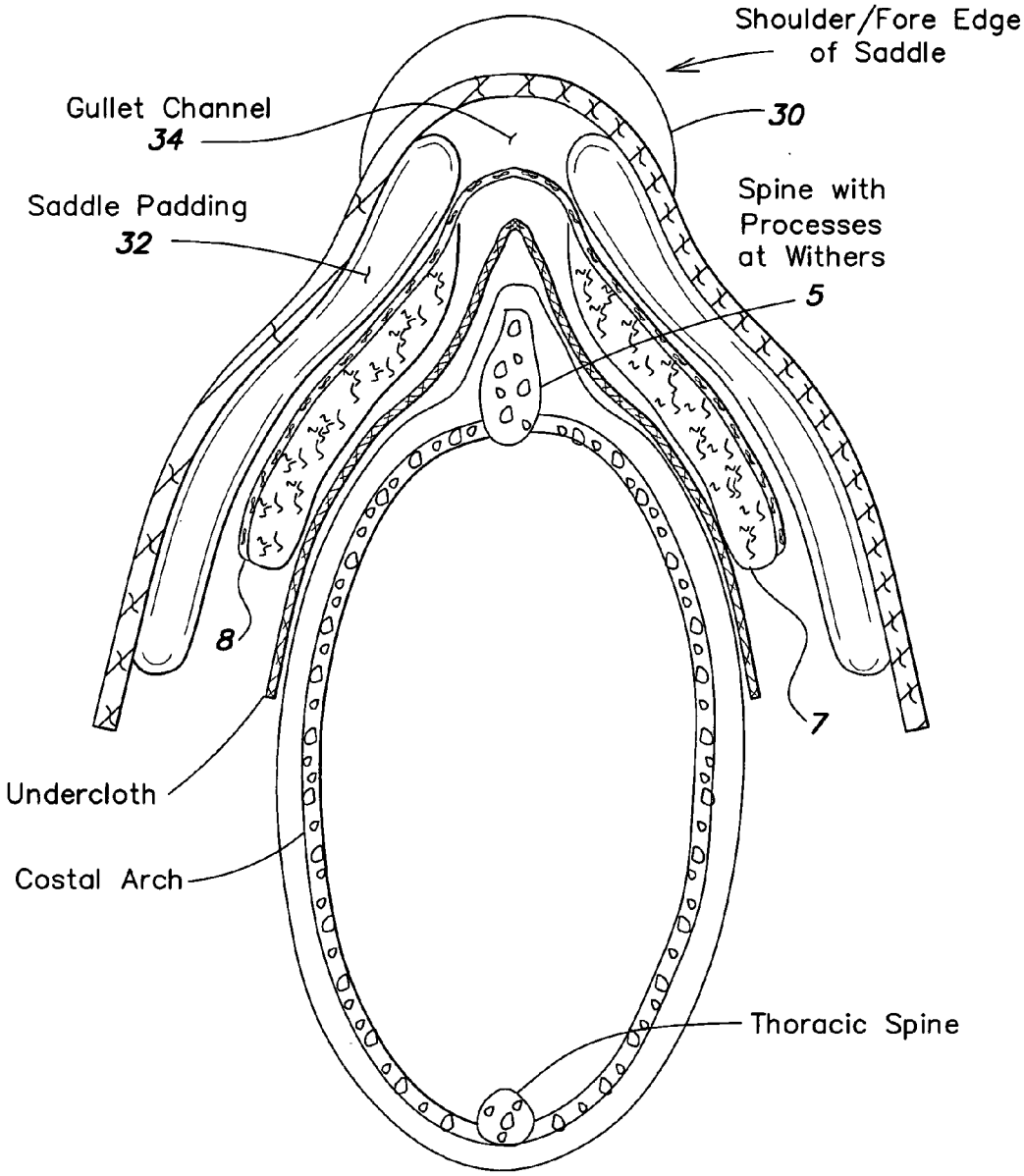
Figure 1C:
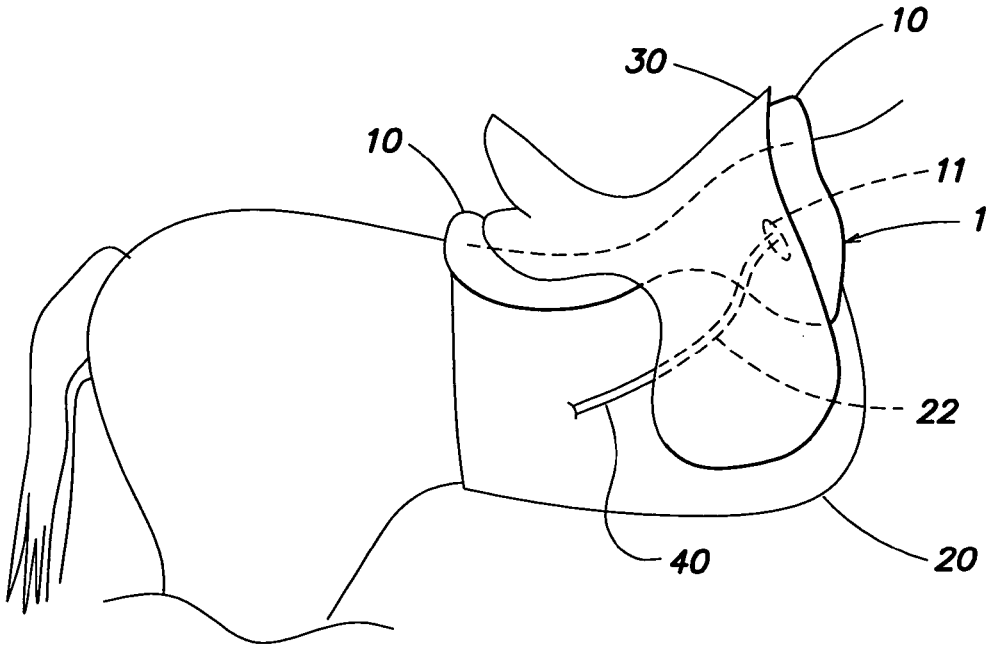
Figure 2:
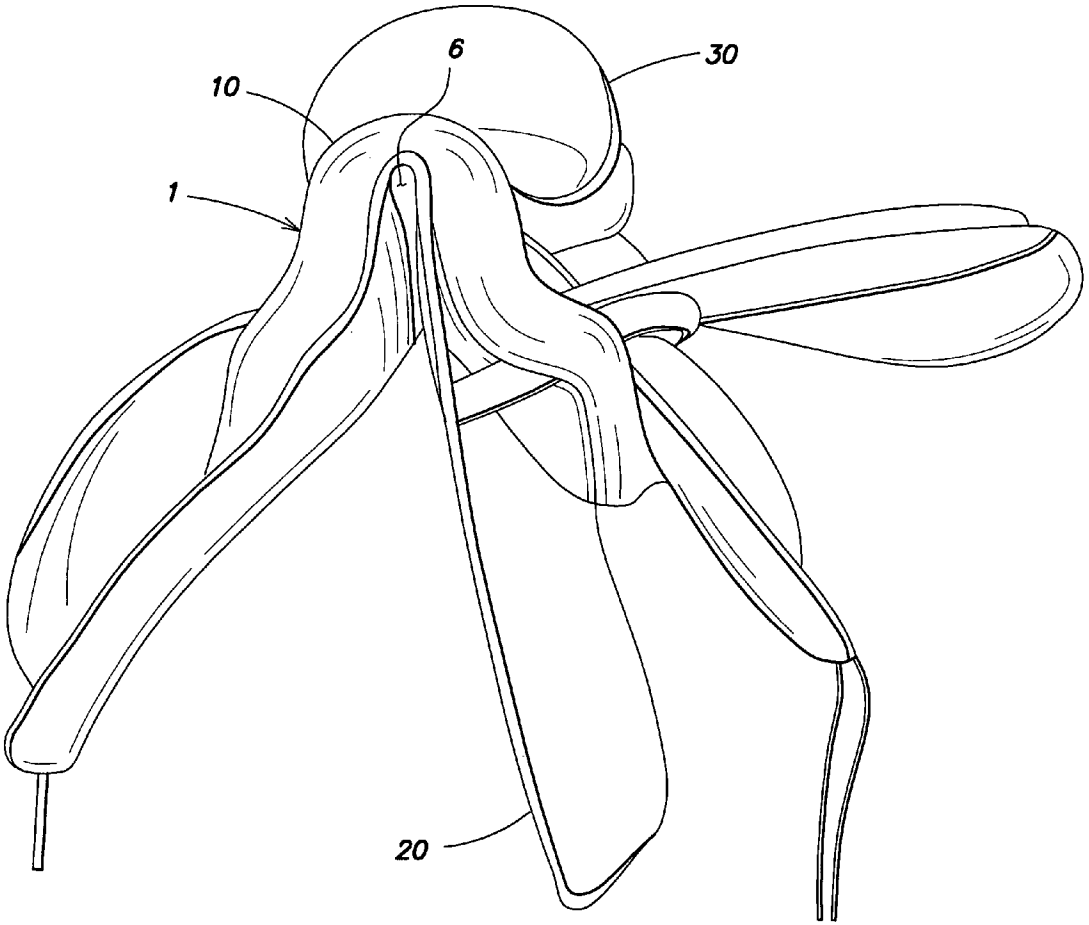
FIG. 2 is a perspective view of the saddle pad with a saddle from obliquely forward.
Figure 3:
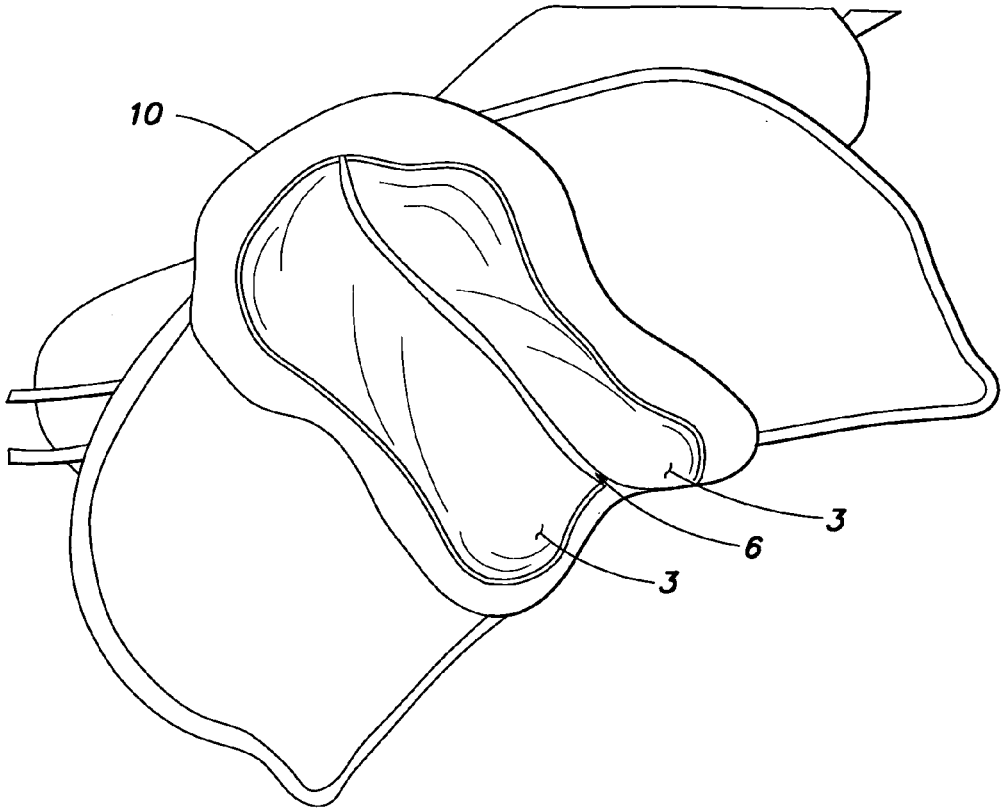
FIG. 3 is a perspective view from obliquely below.
Figure 4:
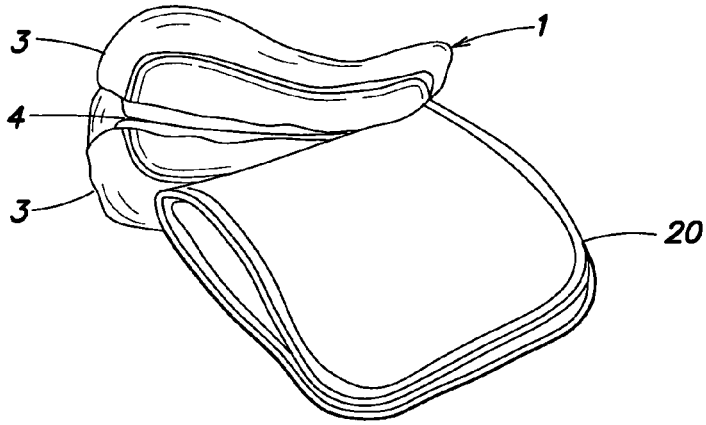
FIG. 4 is a perspective view from obliquely below with saddle pad as well as saddlecloth.

FIGS. 1A and 1B illustrate a cross section through a horse with saddle pad according to the invention set in place. The respective technical names are entered in FIGS. 1A–1C. In FIG. 1C, the horse is depicted in partial lateral view.

Referring to FIGS. 1A–4, the saddle pad 1 rests on the back 2 above the costal arch of the horse. A so-called saddle cloth or caparison 20 can lie between the saddle pad 1 and the horse. A saddle 30 rests on the saddle pad 1, and the saddle 30 includes saddle padding 32. Running centrally on the underside of the saddle 30 is a gullet or so-called gullet channel 34.

The saddle pad 1 comprises two panels 3, which are connected to one another by a web 4 that lies over the spine 5 of the riding animal. The web 4 includes a recess 6 in the shape of a longitudinal groove, which has no lambskin covering but only the textile fabric and is thereby fashioned markedly thinner than the remaining region of the saddle pad 1. This region not covered with lambskin can be discerned quite clearly in FIG. 4. The two panels 3 of the saddlecloth 1 each comprise a lambskin 7 on the upper surface of which there is sewed a textile fabric 8, which is preferably quilted in order to make the padding higher. The saddlecloth 1 rests with the fleece side of the lambskin 7 on the trunk 9 of the riding animal. At the front and/or rear end of the web 4 there is a bulge 10, which fixes saddle pad 1 under the saddle in the gullet channel of the saddle and serves in particular to guard against slipping.

As a result of the fashioning of the saddle pad 1 as described above, the saddle pad is automatically pressed with its web into the gullet channel of the saddle and makes certain at the same time that there is an adequate ventilation channel above the spine of the horse between the horse and the saddle pad.

In a development of the invention, the saddle pad can be combined in a simple way with a saddlecloth 20 to be laid under the saddle pad 1. For this purpose, the saddle pad 1 and the saddlecloth 20 have suitable fastening devices. Thus for example there can be a slit 11 at the front and/or rear of each panel 3, through which slit straps 22 attached to the saddlecloth 20 can be passed. The saddlecloth 20 is fabricated for example from textile fabric. In order to enhance the cushioning effect, this textile cloth can also be quilted.

The saddle pad 1 according to the invention is especially well-suited to saddle horses.

Lambskin is particularly suitable as the lower covering for the saddle pad 1 because the thickness of the upright-standing fibers is sufficiently high and the fibers of the lambskin slide into one another so that friction against the horse's back is largely prevented, even when the saddle moves or the horse moves beneath the saddle. Pressure alone without friction does not cause injury to the horse's skin. Similar results can also be attained with high-quality wool nonwovens, provided the density of the fibers is not brought about by crimping of the fibers.

Although the present invention has been shown and described with respect to several preferred embodiments thereof, various changes, omissions and additions to the form and detail thereof, may be made therein, without departing from the scope and spirit of the invention.

What is claimed is:

1. A saddle pad for laying on the back of a riding animal, comprising a first side panel, a second side panel and a web from which the first and second side panels hang, wherein the web includes a lengthwise groove configured and arranged to overly the spine of the riding animal, so that the panels resting on the flanks of the riding animal have a greater thickness than the web connecting the first and second panels to one another over the spine, where undersides of the first and second panels that contact the riding animal are made of lambskin where said web consists of textile material.

2. The saddle pad of claim 1, where there is a bulge at the front and rear end of the web.

3. The saddle pad of claim 1, where in the front and rear end of each panel there is in each case a device for fastening a saddlecloth.

4. The saddle pad of claim 3, where the front and rear end of each panel there is in each case a slit through which a strap is passed.

5. The saddle pad of claim 4, where a saddlecloth is fastenable under the saddle pad by straps that can be passed through the slits of the panels.

6. The saddle pad of claim 1, where the textile fabric is quilted.

7. A saddle pad for laying on the back of a riding animal, comprising a first side panel, a second side panel and a web from which the first and second side panels hang, wherein the web includes a lengthwise groove configured and arranged to overly the spine of the riding animal, so that the panels resting on the flanks of the riding animal have a greater thickness than the web connecting the first and second panels to one another over the spine, where undersides of the first and second panels that contact the riding animal are made of high-quality wool non-wovens where said web consists of textile material.

* * * * *